US010106226B2

(12) United States Patent
Darling

(10) Patent No.: US 10,106,226 B2
(45) Date of Patent: Oct. 23, 2018

(54) PERSONAL WATERCRAFT CHASSIS

(71) Applicant: Free Form Factory Inc., Sacramento, CA (US)

(72) Inventor: Jordan Darling, Sacramento, CA (US)

(73) Assignee: FREE FORM FACTORY INC., Sacramento, CA (US)

( * ) Notice: Subject to any disclaimer, the term of this patent is extended or adjusted under 35 U.S.C. 154(b) by 0 days.

(21) Appl. No.: 15/224,458

(22) Filed: Jul. 29, 2016

(65) Prior Publication Data

US 2017/0029074 A1 Feb. 2, 2017

Related U.S. Application Data

(60) Provisional application No. 62/282,263, filed on Jul. 29, 2015.

(51) Int. Cl.

| | |
|---|---|
| ***B63B 9/06*** | (2006.01) |
| ***B63B 3/26*** | (2006.01) |
| ***B63B 35/73*** | (2006.01) |

(52) U.S. Cl.

CPC ..... *B63B 3/26* (2013.01); *B63B 35/73* (2013.01)

(58) Field of Classification Search

CPC ..... B63B 35/73; B63B 3/26
USPC ..... 114/65 R, 81, 355–359
See application file for complete search history.

(56) References Cited

U.S. PATENT DOCUMENTS

| | | | | |
|---|---|---|---|---|
| 2,357,806 A | | 9/1944 | Borkland | |
| 2,617,126 A | | 11/1952 | Nebesar | |
| 3,153,796 A | | 10/1964 | Bernhardt | |
| 3,292,969 A | | 12/1966 | Eggert | |
| 3,655,320 A | | 4/1972 | Heavener | |
| 4,021,874 A | | 5/1977 | Alter | |
| 4,250,583 A | * | 2/1981 | Jensen | B63B 7/06 114/354 |

(Continued)

FOREIGN PATENT DOCUMENTS

| | | |
|---|---|---|
| WO | WO/1987/002638 A1 | 5/1987 |
| WO | WO/1989/011995 A1 | 12/1989 |

(Continued)

*Primary Examiner* — Anthony D Wiest
(74) *Attorney, Agent, or Firm* — Inventive Law Inc.; Jim H. Salter

(57) ABSTRACT

The various example embodiments disclosed herein pertain to an internal support structure in a watercraft that interfaces the motor to the hull and decreases the weight of the hull, by eliminating various components. The various example embodiments add structural stability to the overall structure of the hull or body, allowing for thinner hull and deck material. This chassis consists of a metal, composite, and or plastic bent or formed tubular structure that outlines the internal dimensions of the hull. The motor is able to mount to this structure so that the body is no longer the direct point of attachment. This furthers the structural stability and reliability of the hull as it disperses forces over a larger area and mounts to a means more suitable than direct hull mounts, which often shear and break loose from the traditional fiberglass hulls. By mounting the engine to this chassis, the hull can be completely removed without disassembling and other components. This allows easier access to the motor and ease of internal maintenance, and allows for replacement hulls and decks when damaged.

4 Claims, 7 Drawing Sheets

(56) References Cited

U.S. PATENT DOCUMENTS

| | | | | |
|---|---|---|---|---|
| 4,362,519 | A | 12/1982 | Gault | |
| 4,975,236 | A | 12/1990 | Maclachlan | |
| 5,005,510 | A | 4/1991 | Schad | |
| 5,036,789 | A | 8/1991 | Kelly | |
| 5,094,607 | A | 3/1992 | Masters | |
| 5,271,352 | A | 12/1993 | Wilson | |
| 5,433,165 | A | 7/1995 | McGuiness | |
| 5,517,939 | A | 5/1996 | Harman | |
| 5,558,549 | A * | 9/1996 | Nakase | B63B 35/731 114/55.57 |
| 5,588,392 | A | 12/1996 | Bailey | |
| 5,853,650 | A | 12/1998 | Lonno | |
| 5,921,198 | A * | 7/1999 | Yoshida | B63B 3/56 114/271 |
| 5,951,939 | A | 9/1999 | Chernyak | |
| 5,964,178 | A * | 10/1999 | Gonda | B63B 7/06 114/347 |
| 6,325,014 | B1 | 12/2001 | Blanchard | |
| 6,367,361 | B1 | 4/2002 | Christensen | |
| 6,394,020 | B1 | 5/2002 | Vallentuna | |
| 6,412,434 | B1 | 7/2002 | Kaneko | |
| 6,892,666 | B1 * | 5/2005 | Plante | B63B 35/731 114/363 |
| 6,908,108 | B1 | 6/2005 | Scarla | |
| 7,156,043 | B2 | 1/2007 | Sahr | |
| 8,701,585 | B1 | 4/2014 | Seaman | |
| 2001/0042498 | A1 * | 11/2001 | Burnham | B63B 35/7943 114/55.56 |
| 2005/0217555 | A1 * | 10/2005 | Otobe | B63B 35/795 114/343 |

FOREIGN PATENT DOCUMENTS

| | | | |
|---|---|---|---|
| WO | WO/2000/040392 | A1 | 7/2000 |
| WO | WO/2001/070488 | A1 | 9/2001 |

* cited by examiner

PERSONAL WATERCRAFT CHASSIS

PRIORITY PATENT APPLICATION

This is a non-provisional patent application claiming priority to U.S. provisional patent application, Ser. No. 62/282,263; filed Jul. 29, 2015. This non-provisional patent application draws priority from the referenced provisional patent application. The entire disclosure of the referenced patent application is considered part of the disclosure of the present application and is hereby incorporated by reference herein in its entirety.

TECHNICAL FIELD

The various example embodiments is directed to a fabricated, formed, or assembled chassis, frame or structure, which assists in the structural integrity and assembly of, but not limited to personal watercraft. The "chassis" can be used to assist with the creation of watercraft, including, but not limited to, personal watercraft, jet boats, race dinghies, power surfboards, and other aquatic transportation vehicles.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the disclosure and data as described below and in the drawings that form a part of this document: Copyright 2014-2016 Free Form Factory Inc., All Rights Reserved.

BACKGROUND

Related Art

Watercraft, including jetskis, are a common mode of transportation on the water. However, conventional watercraft have physical and structural boundaries that are being pushed by enthusiasts every day. In many cases, the advancement of watercraft engines is outpacing the design and manufacturing of the hulls. The hulls on conventional watercraft are still manufactured using costly, time-consuming, and environmentally detrimental processes. There is a need for a stronger, easier to manufacture, and environmentally-conscious manufacturing process and design for personal watercraft hull, deck, and covering components to accommodate this rapidly advancing industry.

Personal watercraft are currently manufactured using the process of fiberglass layup. This process is used to fabricate standard sport boat types of watercraft hulls in a closed mold resin transfer molding (RTM) process or a vacuum molding process. In a RTM process, a two-piece mold consists of a female dye (cavity) and a male dye (core) used in the process. A composite mixture of resin, reinforcement, filler, and additives is placed between the two matched molds, which are then closed under pressure to cure the composite into a solid reinforced plastic part. The fiberglass manufacturing process is labor-intensive, time-consuming, and releases volatile organic compounds (VOC) that may be toxic to those manufacturing it. Additionally, the fiberglass fabrication process imposes limitations on the performance, durability, and consistency in the manufacturing of watercraft parts.

U.S. Pat. No. 6,908,108 "Rollcage" to Scarla, utilizes a tube-based structure to follow the extremities of the vehicle like an exoskeleton. This concept adds rigidity to the entire body by creating a structure that connects to the chassis and frame of the vehicle into one piece, which allows for a greater distribution of impact forces. This design however does not function alone. A preexisting frame and chassis must exist already. In addition, this current application changes the structure of the vehicle meaning that custom body panels must be made that would not be suitable for watercraft as they would be aesthetic only.

In U.S. Pat. No. 3,292,969 "Tubular Frame Unitized Body Structure" to Eggert, an integrated design is utilized to create a tubular structure that meets the sheet metal floor of a frame. The frame extends to the extremities of the vehicle, which allows the strength and structural integrity. However, the engine still is bolted into the chassis, actually utilizing the motor for structure in frontal collision. Also, the integrated body panels make doors and other elements crucial to the structural stability of the vehicle. Body panels are also riveted onto the structure for stability, but makes them nearly impossible to remove for maintenance.

SUMMARY

The Personal Watercraft Chassis of the various example embodiments disclosed herein allows for the body to be completely independent of the chassis and for the chassis to bolt directly to the motor, but not use the motor for structural means. In the design, an internal skeletal structure fills the internal profile of the hull design, allowing for maximum dispersion of forces. The structure connects only to itself and the body. It does not rely on a frame, sub frame, sheet metal floor, roll cage or additional engine cradle for additional support. The internal profile allows for cross-torsional structural integrity as well. The design of the Personal Watercraft Chassis of the various embodiments allows for the body panels to bolt on and off easily; but, also enables the bolting of body panels in a manner such that the body splits in only to places. This allows for the easiest means for sealing the structure from water making it a reliably buoyant structure. The various example embodiments disclosed herein greatly reduce manufacturing costs, decrease manufacturing time; increase part consistency, and offer better performance characteristics and durability.

The various example embodiments include a fabricated, formed, or assembled chassis, frame or structure, which assists in the structural integrity and assembly of, but not limited to personal watercraft. The "chassis" can be used to assist with the creation of watercraft, including, but not limited to, personal watercraft, jet boats, race dinghies, power surfboards, and other aquatic transportation vehicles.

The various example embodiments relate to a chassis or frame component for, but not limited to, personal watercraft. The various example embodiments relate to a center body structure of personal watercraft, and more particularly to the mounting of drivetrain and components thereof. The implementation and design of the chassis enables a means for replaceable decks or hulls as well as adding capabilities for universal mounting, whilst increasing durability and structural integrity to current hull designs.

Watercraft designs currently rely on structural integrity from fiberglass to bolt the engine in place. This rudimentary practice is time consuming, unreliable, and over time weakens the overall structure of the hull. In order for the sport and industry to progress a solution for allowing for rapid engine installation/removal is required. More importantly, a rigid sub structure that interfaces the drivetrain mounting with the hull, to decrease overall hull weights, increase durability and structural integrity, allowing for easy maintenance, flexible components and overall preservation of the hull's structural integrity.

A primary objective of the various example embodiments is to decrease the weight of the hull, increase the performance, and provide a structure for which the motor or drivetrain can be mounted as an alternative to mounting directly to the hull or body, which is the current method. Utilization of this chassis allows for a more rigid hull design, and increased structural stability of the hull, as there are no direct mounts into the hull material that would otherwise cause stress fractures or shearing. In addition the chassis allows for a more convenient means of maintenance by allowing for the first time a jetski hull to be independent of the motor, meaning the hull or body can be quickly detached for easy access to the motor. Under the same premise, this also benefits the manufacturing time allowing the factory to assemble a full jetski in less time, with higher accuracy and lower cost, as expensive, hazardous and unforgiving adhesives are now no longer needed. In one embodiment of the various example embodiments, a tubular structure is bent and welded to reflect the internal volume of a personal watercraft hull.

Manufacturing personal watercraft hulls, decks, hoods, and covering components comprises the use of molds, male or female, to which the thermoset plastic or other thermoplastic material will form, thereby creating the desired components. The formed sheets of thermoplastic material can then be trimmed to the specified part for final assembly. This process greatly reduces manufacturing costs, decreases manufacturing time, increases part consistency, offers better performance characteristics and durability, and results in less environmentally harmful deposits and waste.

An objective of the various example embodiments is to provide a means of manufacturing personal watercraft hulls, decks, hoods, and covering components so that they are more durable and rigid, easier to manufacture, quicker to manufacture, and result in less environmentally harmful waste. In various example embodiments, a thermoforming manufacturing process is used to fabricate personal watercraft hulls, decks, hoods, and covering components.

In an example embodiment, a personal watercraft hull, deck, hood, and covering components will resist higher impacts, because of the method of thermoform manufacturing as disclosed herein.

In an example embodiment, a personal watercraft hull, deck, hood, and covering components will have decreased manufacturing times, because of the method of thermoform manufacturing as disclosed herein.

In an example embodiment, a personal watercraft hull, deck, hood, and covering components will have increased consistency per part, because of the method of thermoform manufacturing as disclosed herein.

In an example embodiment, a personal watercraft hull, deck, hood, and covering components will be environmentally friendly and recyclable, because of the method of thermoform manufacturing as disclosed herein.

Other features and advantages of the example embodiments will become apparent from the following detailed description taken in conjunction with the accompanying drawings which illustrate, by way of example, the principles of the example embodiments.

BRIEF DESCRIPTION OF THE DRAWINGS

For a better understanding of the example embodiments, reference should be made to the following detailed description disclosed in conjunction with the accompanying drawings, in which.

DETAILED DESCRIPTION

Figure 1:
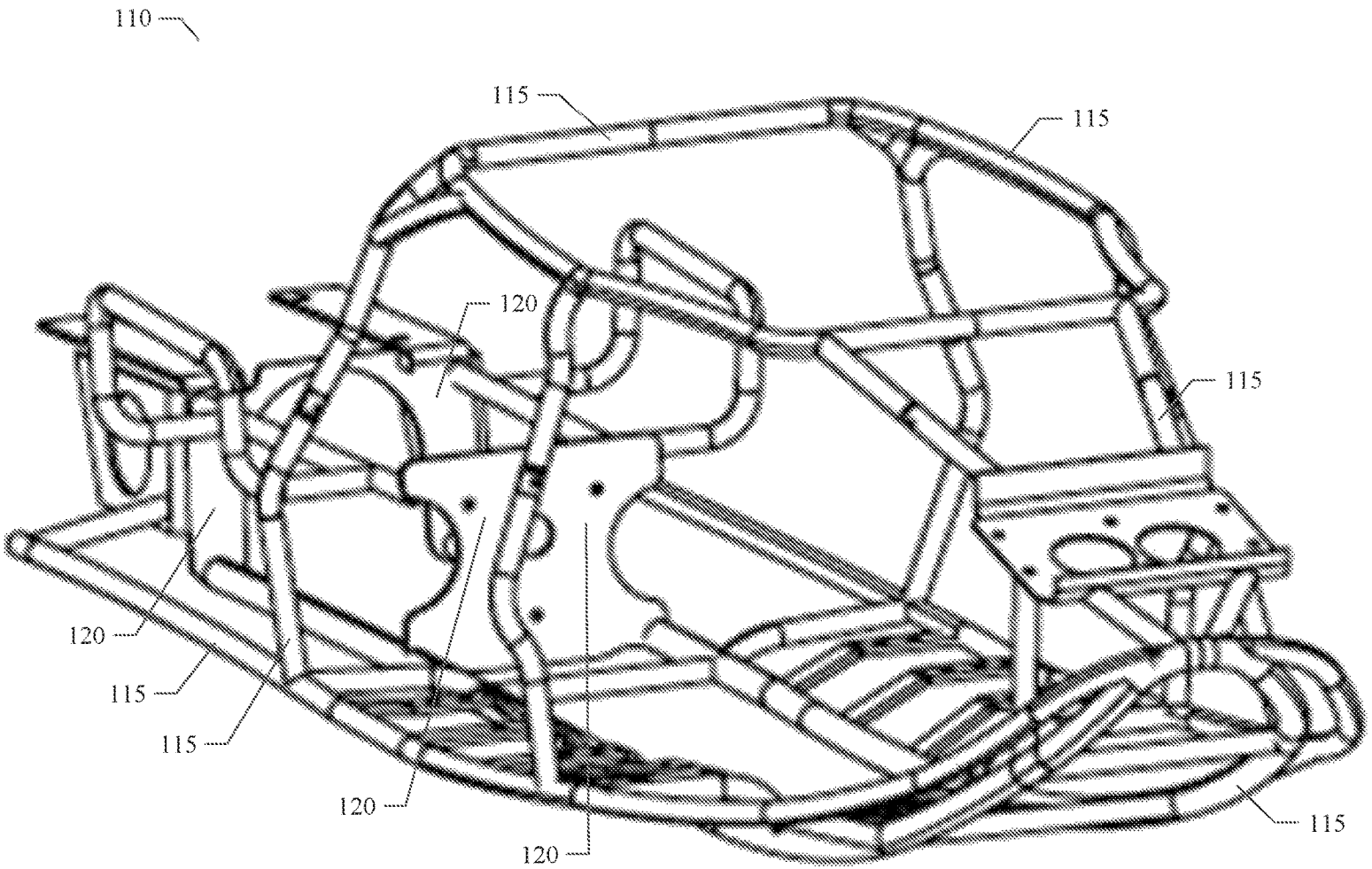
FIG. 1 is an isometric view of a personal watercraft chassis.
Figure 2:
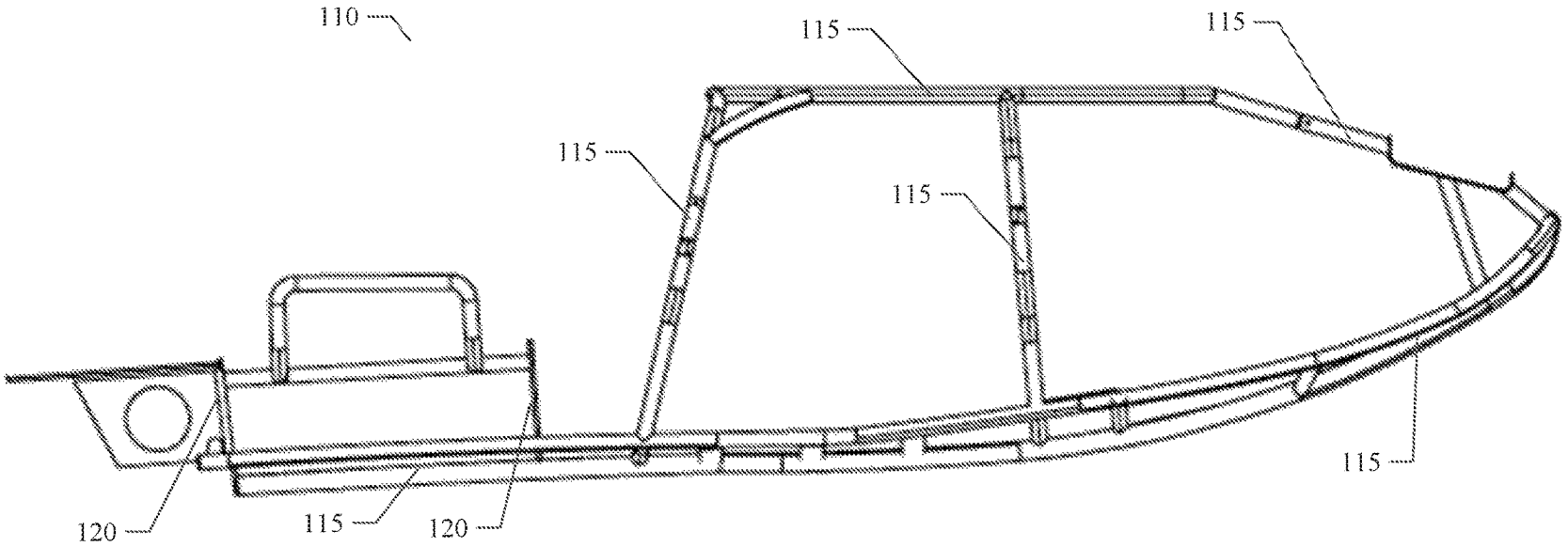
FIG. 2 is a side view of a personal watercraft chassis.
Figure 3:
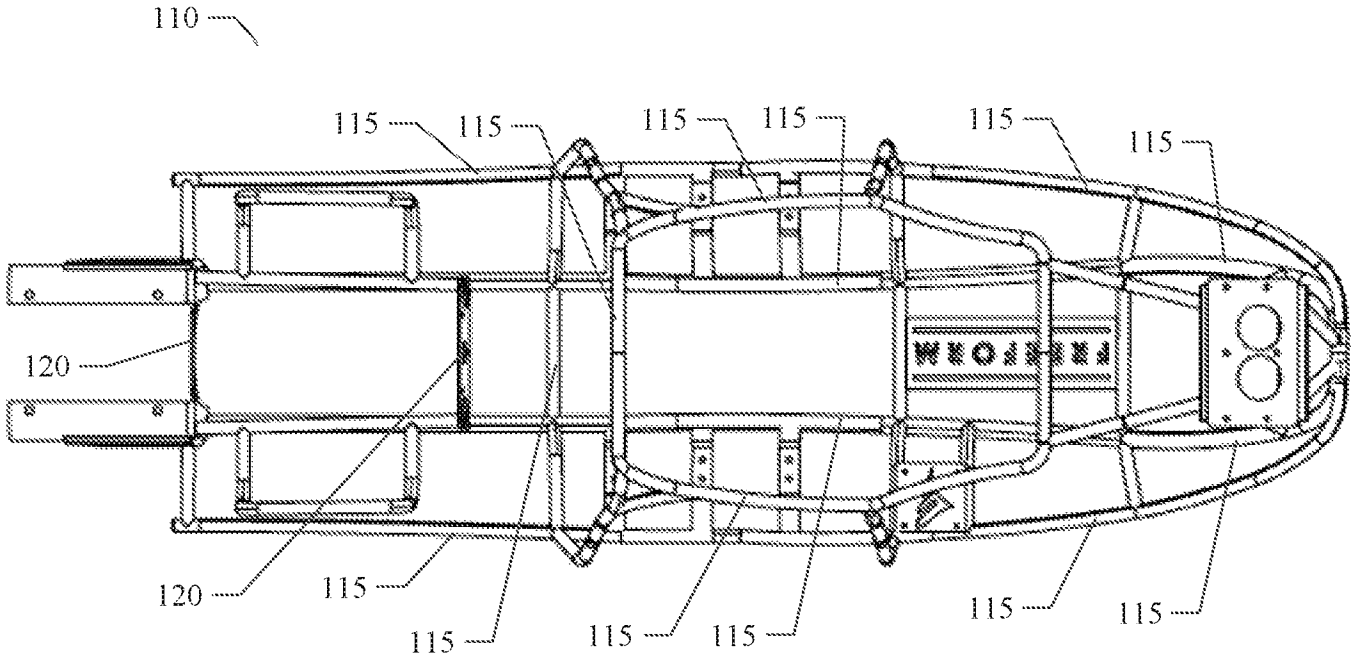
FIG. 3 is a top view of personal watercraft chassis.
Figure 4:
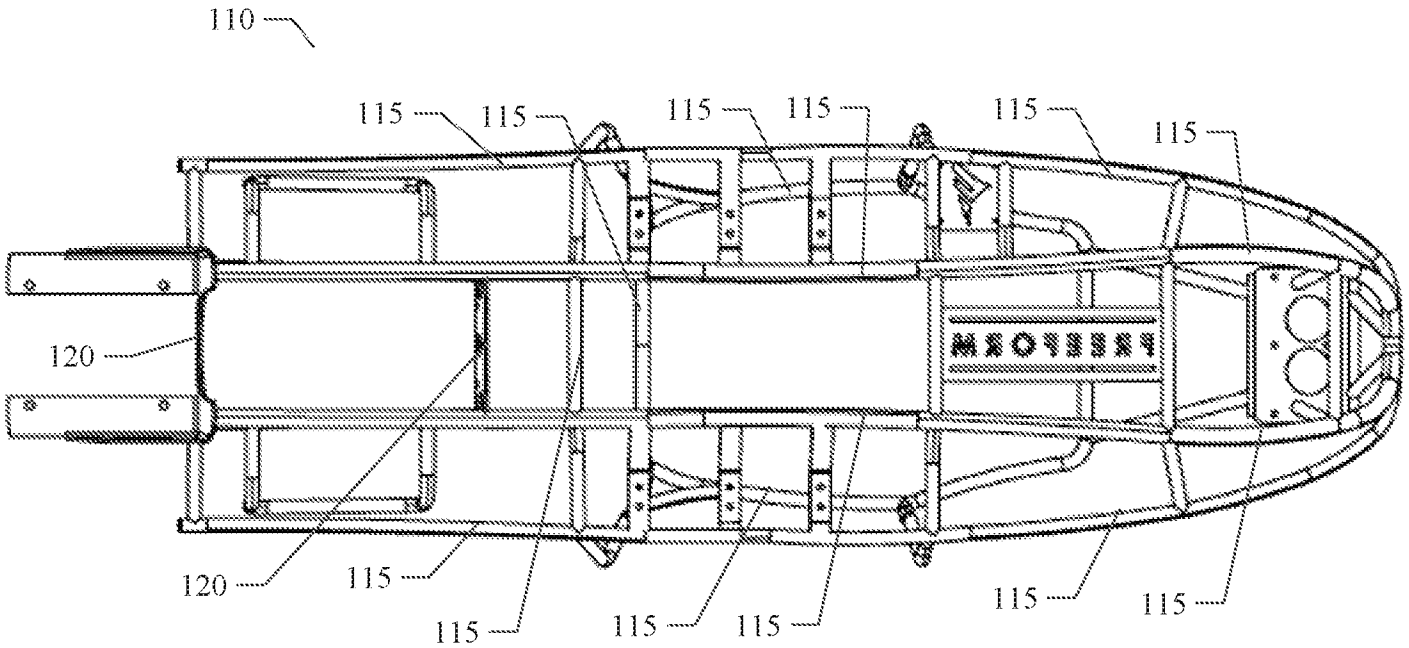
FIG. 4 is a bottom view of a personal watercraft chassis.
Figure 5:
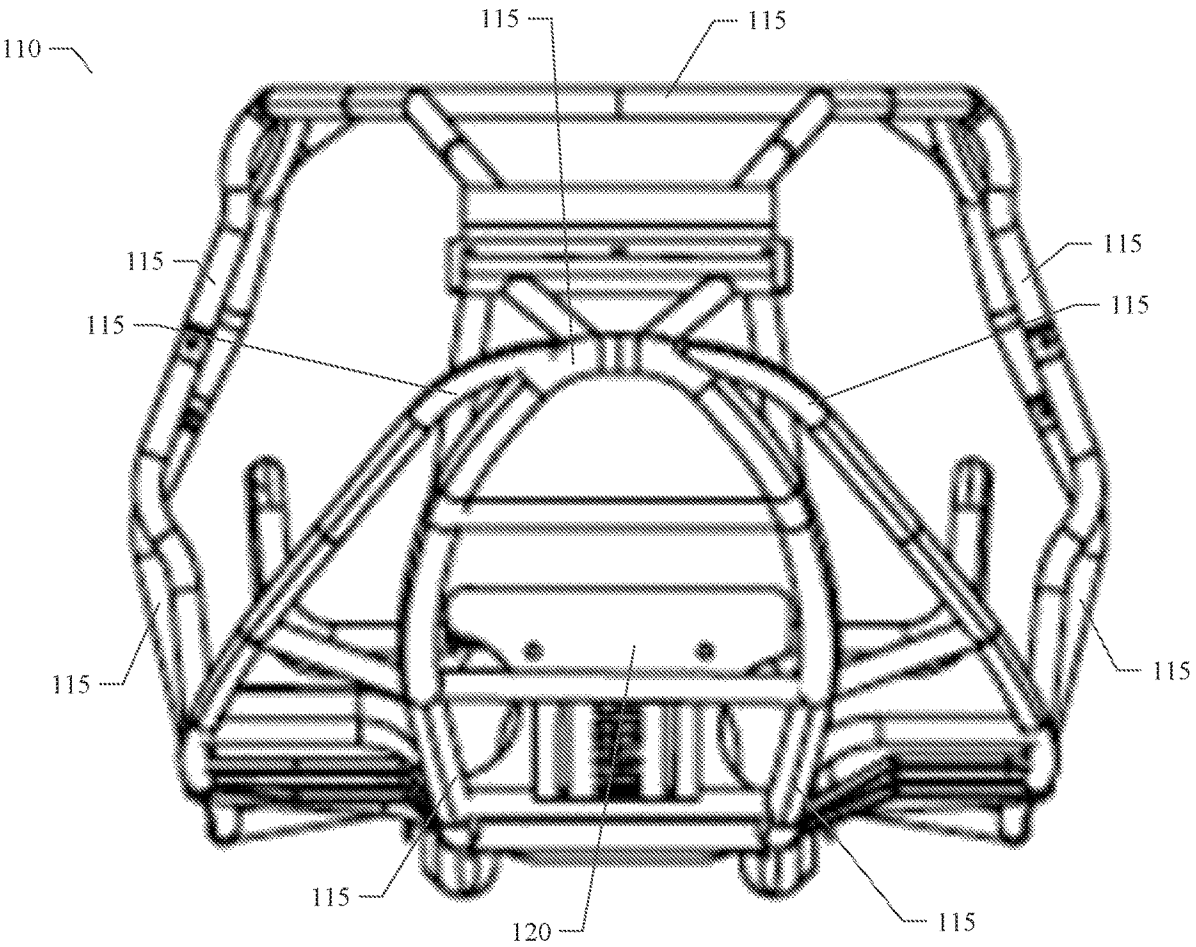
FIG. 5 is a front view of a personal watercraft chassis.
Figure 6:
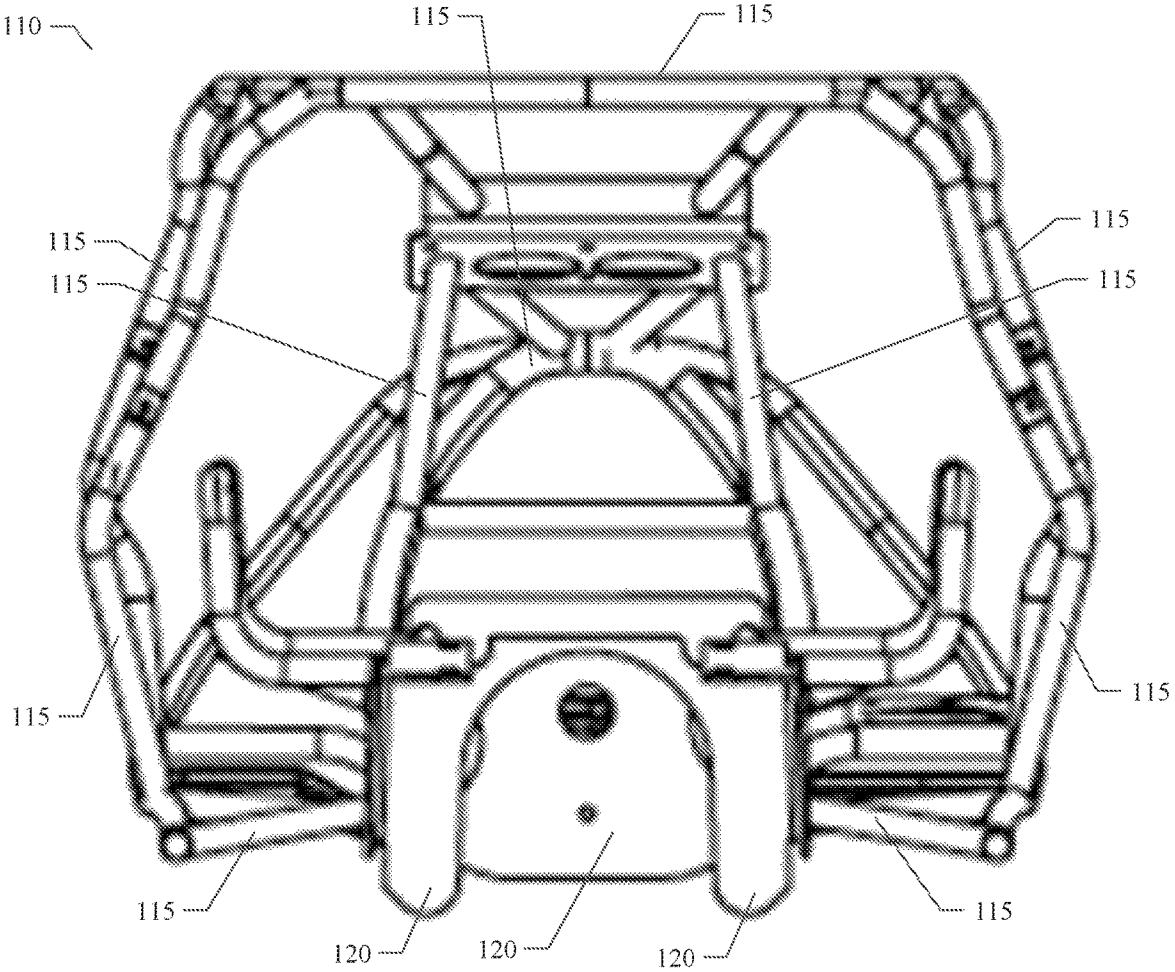
FIG. 6 is a rear view of a personal watercraft chassis.

Reference will now be made in detail to the example embodiments illustrated in the accompanying drawings. Wherever possible, the same reference numbers will be used throughout the drawings to refer to the same or like parts. Personal watercraft chassis and personal watercraft fabrication using a thermoforming process are described herein.

The Personal Watercraft Chassis 110 of the various example embodiments disclosed herein and shown in FIGS. 1 through 6 allows for the body to be completely independent of the chassis 110 and for the chassis 110) to bolt directly to the motor, but not use the motor for structural means. In the design, an internal skeletal structure fills the internal profile of the hull design, allowing for maximum dispersion of forces. The structure connects only to itself and the body. It does not rely on a frame, sub frame, sheet metal floor, roll cage or additional engine cradle for additional support. The internal profile allows for cross-torsional structural integrity as well. The design of the Personal Watercraft Chassis 110 of the various embodiments shown in FIGS. 1 through 6 allows for the body panels to bolt on and off easily; but, also enables the bolting of body panels in a manner such that the body splits in only two pieces. This allows for the easiest means for sealing the structure from water making it a reliably buoyant structure. The various example embodiments disclosed herein greatly reduce manufacturing costs, decrease manufacturing time; increase part consistency, and offer better performance characteristics and durability.

The various example embodiments include a fabricated, formed, or assembled chassis, frame or structure, which assists in the structural integrity and assembly of, but not limited to personal watercraft. The "chassis" can be used to assist with the creation of watercraft, including, but not limited to, personal watercraft, jet boats, race dinghies, power surfboards, and other aquatic transportation vehicles.

The various example embodiments relate to a chassis 110 or frame component for, but not limited to, personal watercraft. The various example embodiments relate to a center body structure of personal watercraft, and more particularly to the mounting of drivetrain and components thereof. The implementation and design of the chassis 110 enables a means for replaceable decks or hulls as well as adding capabilities for universal mounting, whilst increasing durability and structural integrity to current hull designs.

Watercraft designs currently rely on structural integrity from fiberglass to bolt the engine in place. This rudimentary practice is time consuming, unreliable, and over time weakens the overall structure of the hull. In order for the sport and industry to progress a solution for allowing for rapid engine installation/removal is required. More importantly, a rigid sub structure 115 that interfaces the drivetrain mounting with the hull, to decrease overall hull weights, increase durability and structural integrity, allowing for easy maintenance, flexible components and overall preservation of the hull's structural integrity.

The various example embodiments disclosed herein provide an internal support structure 115 in a watercraft that interfaces the motor to the hull 210/220 and decreases the weight of the hull 210/220, by eliminating various components. The various example embodiments add structural stability to the overall structure of the hull or body 210/220, allowing for thinner hull and deck material. This chassis 110 consists of a metal, composite, and or plastic bent or formed tubular structure 115 that outlines the internal dimensions of the hull 210/220. The motor is able to mount to this structure 120 so that the body is no longer the direct point of attachment. This furthers the structural stability and reliability of the hull 210/220 as it disperses forces over a larger area and mounts to a means more suitable than direct hull mounts, which often shear and break loose from the traditional fiberglass hulls. By mounting the engine to this chassis 110, the hull 210/220 can be completely removed without disassembling and other components. This allows easier access to the motor and ease of internal maintenance, and allows for replacement hulls and decks when damaged.

Figure 7:
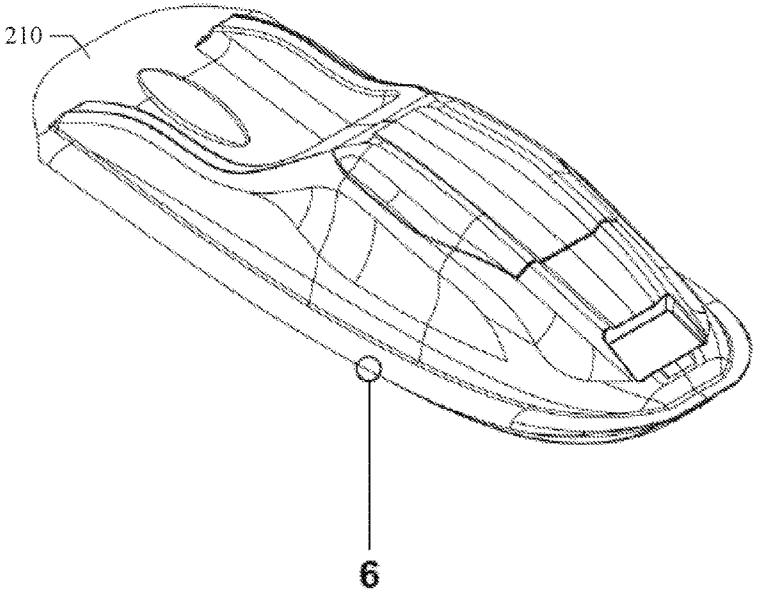
FIG. 7 is a perspective view of an assembled hull, top deck, and hood manufactured by the method of thermoform manufacturing according to an example embodiment.
Figure 8:
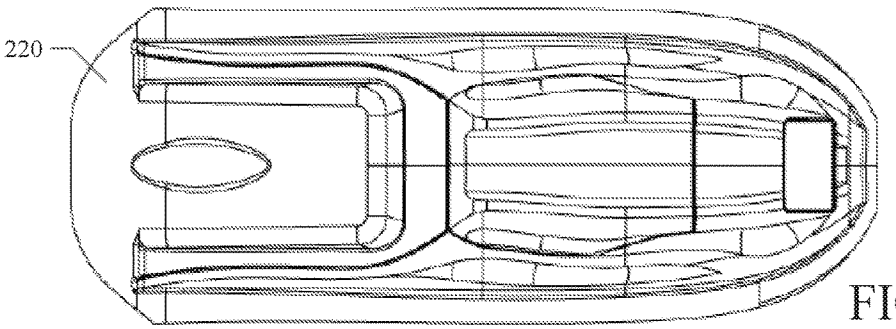
FIG. 8 is a top view of the assembled hull, top deck, and hood manufactured by the method of thermoform manufacturing according to an example embodiment.

Referring to FIGS. 7 and 8 in the example embodiment, the illustrated bottom hull component mold and top deck component mold include a feature used to form bond rails 6 for both the top deck component 210 and the hull/bottom deck component 220 on the fabricated watercraft (e.g., see FIG. 7). The bond rails 6 provide a means of mounting or bonding the thermoform-fabricated top deck component 210 to the thermoform-fabricated bottom hull/deck component 220. In an example embodiment, the bond rails 6 are produced with a unique curvature downward, built into the hull (not an aftermarket add on) and providing the rider with additional handling performance. In particular, the downward curvature of the bond rails 6 act as a fin when the rider leans into a turn. The enlarged curved bond rails 6 prevent the watercraft from submerging on landings and washing the rider out of the foot tray. Because of the precision manufacturing enabled by the thermoforming process used herein, the top deck 210 and bottom hull 220 can be fabricated with tight tolerances, allowing for a sealable joint between the top deck 210 and bottom deck 220. The bond rail 6 in the nose/bow of the watercraft is configured to be flat and short. This configuration allows for easy entry of the watercraft into the water, when entering the water bow first. A longer bond rail in the nose/bow of the watercraft would increase the shock/force when entering the water. In an example embodiment, the bottom hull component 220 can be coupled to a top deck component 210 at a set of bond rails 6, encompassing the internal chassis 110.

A primary objective of the various example embodiments is to decrease the weight of the hull 210/220, increase the performance, and provide a mounting or coupling structure 120 for which the motor or drivetrain can be mounted as an alternative to mounting directly to the hull or body 210/220, which is the current method. Utilization of this chassis 110 allows for a more rigid hull design, and increased structural stability of the hull 210/220, as there are no direct mounts into the hull material that would otherwise cause stress fractures or shearing. In addition the chassis 110 allows for a more convenient means of maintenance by allowing for the first time a jetski hull 210/220 to be independent of the motor, meaning the hull or body 210/220 can be quickly detached for easy access to the motor. Under the same premise, this also benefits the manufacturing time allowing the factory to assemble a fill jetski in less time, with higher accuracy and lower cost, as expensive, hazardous and unforgiving adhesives are now no longer needed. In one embodiment of the various example embodiments, a tubular structure 115 is bent and welded to reflect the internal volume of a personal watercraft hull 210/220. The various example embodiments of the chassis 110 described herein give the watercraft rigidity, where needed, increasing the impact resistance and structural strength of the watercraft. The various example embodiments of the chassis 110 described herein make the entire watercraft modular with replacement hulls and decks. The various example embodiments of the chassis 110 described herein provide a modular design utilizing the internal chassis 110, which provides more ergonomic accessibility to work on the driveline for repairs, and or the assembly of the watercraft.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A personal watercraft comprising:

an internal chassis serving as a component of the personal watercraft, the chassis being formed as a rigid substructure in a shape conforming to an internal area of the personal watercraft defined by a body of the personal watercraft, the body consisting of two pieces, a bottom hull component and a top deck component being coupled together at a set of bond rails around a periphery of the bottom hull component and the top deck component, wherein the rigid substructure is comprised of metal, composite, or plastic members bent or formed into a shape that conforms to the internal dimensions of the personal watercraft, the bottom hull component being a single piece extending the full length of the personal watercraft from bow to stern, the chassis including a mounting structure that couples a motor and a drivetrain directly to the chassis, the body sealing the chassis in a watertight structure, the body being removably attached to the chassis, the body not being directly attached to the motor and the drivetrain, and the bottom hull component not providing structural support for the motor and drivetrain.

2. The apparatus of claim 1 wherein the bottom hull component and the top deck component being thermoform fabricated with formed sheets of thermoplastic material.

3. The apparatus of claim 1 wherein the bond rails at the bow of the personal watercraft are configured to be integrated into the bottom hull component and the top deck component with a downward curvature.

4. The apparatus of claim 1 enabling a modular design thereby enabling the body to be removed from the chassis without disassembly of the chassis.

* * * * *